US005530993A

United States Patent [19]

Hayakawa

[11] Patent Number: 5,530,993

[45] Date of Patent: Jul. 2, 1996

[54] DEVICE FOR HOLDING A FLAP DOOR TO A HORIZONTAL POSITION

[75] Inventor: Tatsuya Hayakawa, Tokyo, Japan

[73] Assignee: Sugatsune Industrial Co., Ltd., Tokyo, Japan

[21] Appl. No.: 239,970

[22] Filed: May 9, 1994

[30] Foreign Application Priority Data

Jul. 13, 1993 [JP] Japan ..... 5-043455 U

[51] Int. Cl.[6] ..... E05D 11/10; E05D 15/06

[52] U.S. Cl. ..... 16/332; 16/348; 16/333; 16/362; 16/364

[58] Field of Search ..... 16/332, 333, 334, 16/348, 362, 363, 321, 364

[56] References Cited

U.S. PATENT DOCUMENTS

| | | | |
|---|---|---|---|
| 2,515,071 | 7/1950 | Battersby | 16/362 |
| 4,995,143 | 2/1991 | Demura et al. | 16/362 |

FOREIGN PATENT DOCUMENTS

| | | | |
|---|---|---|---|
| 1784748 | 9/1971 | Germany | 16/362 |
| 3300189 | 7/1984 | Germany | 16/362 |
| 3533988 | 4/1987 | Germany | 16/362 |
| 324282 | 1/1930 | United Kingdom | 16/362 |

*Primary Examiner*—Daniel W. Howell
*Assistant Examiner*—Donald M. Gurley
*Attorney, Agent, or Firm*—Jacobson, Price, Holman & Stern

[57] ABSTRACT

A device for holding a flap door to a horizontal open position under a locked condition can reduce any undesired load that may be applied to the flap door when it is unlocked so that the latter can be opened softly and lightly to avoid tear and wear of the related components and prolong the service life. A bracket 6 is rigidly fitted to a cut-out section 5 of the front edge of the top plate 2 of a hollow body 1 and then the inner cylinder 9*a* of a damper 9 is rigidly secured to the bracket. As the outer sleeve 9*b* of the damper 9 is rigidly secured to the flap door 18 by way of a slide rail assembly 19, the flap door 18 is turned open as the outer sleeve 9*a* of the damper 9 is rotated until a roller pin 11 slidably fitted to the bracket 6 and urged forward by a spring 16 comes into engagement with an oblong notch 10 arranged on the outer peripheral surface of the outer sleeve 9*b* of the damper 9, when the flap door 18 is in the horizontal open position and locked there. Each of a pair of curved slots 15, 15 of the bracket 6 for slidably holding the roller pin 11 extends obliquely from an upper front portion down to a lower rear portion of the lateral plates with a given radius of curvature so that the roller pin 11 may gyrates as it is guided by the curved slots.

5 Claims, 5 Drawing Sheets

DEVICE FOR HOLDING A FLAP DOOR TO A HORIZONTAL POSITION

BACKGROUND OF THE INVENTION

1. Technical Field

This invention relates to a device for holding a flap door to a horizontal position so that, when opened, it may be kept flat on the top wall of a hollow body such as a cabinet to which the flap door is fitted in order to maximize the open space available to the user.

2. Prior Art

A flap door provided with a damper is advantageous in that the action of closing the door is carried out without impact, because once the door is pulled forward, the damper reduces the torque generated by the dead weight of the door and brakes any sudden movement of the door so that the latter may be closed softly without giving out any shock.

A flap door having a damper of the above identified type is, however, not without defect, because, if it is turned upward to a horizontal position by hand and then left out of the hand, the door can unintentionally be turned downward to the closed position by its own dead weight and, if the flap door is on the way to the closed position from a position when it is held back on the top wall of hollow body such as a cabinet to which is is fitted and has been moved forward by more than a half of its height, in other words, if the center of gravity of the flap door has passed the axis of rotation of the damper, when the hand holding it is pulled away from it, leaving the door to turn further by itself, the door can abruptly fling forward and downward to a great danger of the user as it is turned downward by the torque generated by its own dead weight.

In an attempt to avoid this particular problem, an improved flap door having a damper has been proposed by the applicant of the present application, said improvement consisting in keeping the door open at a horizontal position under a locked condition when it is turned open from the closed vertical position so that it may not unintentionally turn back to the closed position, if the hand holding it is pulled away from it and also it may not unintentionally fling forward if the hand holding it is pulled away from it if the hand holding it is pulled away from it if it is turned forward and downward from a position where it is held on the top wall of a hollow body such as a cabinet to which it is fitted all the way to the closed vertical position.

FIG. 9 of the accompanying drawings schematically shows a side view of an embodiment of an improved flap door proposed by the applicant of the present application. Referring to FIG. 9, a hollow body a such as a cabinet to which the embodiment of a flap door 1 is fitted has a cut-out section b. A bracket c is fitted to the cut-out section b, said bracket c comprising a bottom plate and a pair of lateral plates h, h. Said bottom plate f has a recess e cut along a side thereof and a groove g having an opening connected to the recess e. Said lateral plates h, h have horizontal slots j, j for slidably holding a lock pin i extending between the lateral plates h, h at the opposite ends thereof. A spring k is disposed in said groove g to urge the lock pin forward such that, in the open horizontal position of the door l, the lock pin i engages a notch n arranged on the outer periphery of the outer sleeve m of the damper d of the embodiment to hold the door l to the open horizontal position.

With a flap door having a damper according to the previous invention of the applicant of the present application and having a configuration as described above, since the slots j, j for slidably holding the lock pin i is straight and extends horizontally, the spring k is deformed to a great extent when the lock pin i is released from its locked condition, although not so remarkably when the door l is held horizontal and the lock pin i is engaged with the notch n. Therefore, under the released condition of the lock pin i, undesirably large force is required to open the flap door, because of the friction between the lock pin i and the outer peripheral surface of the outer sleeve m of the damper d, if the door l is not supposed to require such large force for opening once the lock pin i is released. Additionally, the outer sleeve m and the lock pin i also show large friction otherwise and can be worn out in a relatively short period of time.

In view of the above described and other problems of the prior art, it is an object of the present invention to provide a device for holding a flap door to a horizontal position by arranging a pair of curved roller pin receiving slots having a given radius of curvature in the device so that a roller pin which is slidably received by said slots is unlocked as the flap door is turned from the open horizontal position to the closed vertical position without applying large pressure on the outer peripheral surface of the outer sleeve of a damper if the spring that urges the roller pin is deformed to a great extent and consequently there may not arise any undesired load when the door is being opened while the friction between the roller pin and the outer peripheral surface of the outer sleeve of the damper and hence the wear of these components may be minimized to prolong the service life of the flap door by arranging the roller pin to rotate along the outer peripheral surface of the outer sleeve of the damper as the roller pin is strongly urged by the heavily deformed spring.

Another object of the present invention is to provide a device for holding a flap door to a horizontal position by an arrangement substantially the same as described above, wherein the roller pin is not received by a pair of curved slots but supported by a pair of links connected to the opposite ends of the roller pin in order to bring forth a similar effect.

SUMMARY OF THE INVENTION

According to a first aspect of the present invention, the above first object is achieved by providing a device for holding a flap door to a horizontal position, said flap door comprising a damper to be fitted to a bracket arranged in a cut-out section of the front edge of the top wall of a hollow body such as a cabinet with its inner cylinder rigidly secured to the hollow body and a slide rail assembly having a longer outer rail and a shorter rail mutually slidably combined with a pole retainer arranged therebetween and securely and vertically fitted to the inner surface of the flap door, said inner rail being rigidly fitted to the outer sleeve of the damper so as to allow the flap door to move between a fully open position of being removably laid on the upper surface of the top wall of the hollow body and a closed position by a combination of swinging and sliding movements, characterized in that said bracket comprises a bottom plate and a pair of lateral plates, said bottom plate having a recess cut along thereof and a groove having an opening connected to the recess, said lateral plates having respective curved slots extending obliquely from an upper front portion down to a lower rear portion of the lateral plates with a given radius of curvature for slidably holding a roller pin extending between the lateral plates at the opposite ends thereof, and a spring disposed in said groove to forwardly urge the roller pin, the outer sleeve of the damper having a notch arranged on the outer periphery thereof for releasably engaging said roller at an open horizontal position of the flap door in order to hold the door to the open horizontal position.

According to a second aspect of the present invention, the above first object is achieved by providing a device for holding a flap door to a horizontal position similar to the one described above but characterized in that said bracket comprises a bottom plate and a pair of lateral plates, said bottom plate having a recess cut along thereof and a groove having an opening connected to the recess, said lateral plates having respective links pivotably fitted thereto at a lower end portion of the links for holding a roller pin extending between the lateral plates at the opposite ends thereof, said roller pin being rotatable with a given radius of gyration, and a spring disposed in said groove to forwardly urge the roller pin, the outer sleeve of the damper having a notch arranged on the outer periphery thereof for releasably engaging said roller at an open horizontal position of the flap door in order to hold the door to the open horizontal position.

With a device according to the first aspect of the invention, when the flap door in the closed vertical position is pulled forward by hand to turn it forward, the force applied thereto to turn it upward is transmitted to the outer sleeve of the damper by way of the slide rail assembly so that the outer sleeve of the damper is rotated relative to the inner cylinder without resistance exerted to the flap door until the latter is rotated to a horizontal position, where it is held stationarily.

Since the roller pin is urged to press against the outer sleeve of the damper by the resilient force of the spring while the flap door is turned upward, the roller pin rotates or slides on the outer peripheral surface of the outer sleeve as the latter rotates and, when the flap door is turned to the horizontal position, the roller pin comes to engage the outer sleeve to lock the flap door in that position so that it may be held there, if the hand holding it is pulled away from it.

Referring to FIG. 5 of the accompanying drawings schematically illustrating the principle of the operation of the device, once the flap door is locked in a horizontal position, the moment stored in the spring takes the form of spring force represented by vector P, which is directed to the center of the roller pin and can be divided into component vector P' and P", the vector P" passing through or being directed to the center of curvature B of the curved slot of each of the lateral plates and hence representing the pressure of the spring force, the vector P' being perpendicular to the vector P".

On the other hand, the vector P' can by turn be divided into component vectors $P_1'$ and $P_2'$, the vector $P_1'$ passing through or being directed to the axis of the outer sleeve of the damper, the vector $P_1'$ being perpendicular to the vector $P_2'$ to prove that, after all, the net pressure applied to the outer surface of the outer sleeve and directed to the axis of the outer sleeve is $P_2'$.

Referring now to FIG. 6 of the accompanying drawings also schematically illustrating the principle of the operation of the device, the spring is more deformed when the flap door is being opened than when the latter is in the above described locked open position, the moment stored in the spring also taking the form of spring force represented by vector P in FIG. 6, which is directed to the center of the roller pin.

Again, the vector P can be divided into component vectors P' and P", the vector P" passing through or being directed to the center of curvature B of the curved slot of each of the lateral plates, the vector P' being perpendicular to the vector P".

The vector P" represents the pressure of the spring force whereas the vector P' can by turn be divided into component vectors $P_1'$ and $P_2'$, the vector $P_2'$ passing through or being directed to the axis of the outer sleeve of the damper, the vector $P_2'$ being perpendicular to the vector $P_2'$, $P_1'$ to prove that, after all, the net pressure applied to the outer surface of the outer sleeve and directed to the axis of the outer sleeve is $P_2'$.

Thus, although the spring is deformed to a large extent, while the flap door is being opened to raise the spring force P, the pressure applied to the outer peripheral surface of the outer sleeve of the damper by the roller pin is not subjected to a sudden increase in the pressure applied to the hand when he or she is opening the flap door by hand and hence the flap door is turned lightly to the horizontal open position.

When the flap door is pushed rearward in the horizontal position, the outer rail is slidingly moved relative to the inner rail rigidly fitted to the outer sleeve of the damper so that the flap door moves back along the upper surface of the top wall of the hollow body such as a cabinet until it is completely held back on the top wall to take a "put away" position.

If, now, the flap door is pulled forward from the "put away" position to the horizontal locked position and then the front end of the flap door is pressed downward by hand, the force applied to the front end of the flap door is transmitted to the outer sleeve of the damper by way of the slide rail assembly as rotary force trying to rotate it in the sense opposite to that in which it is rotated when the flap door is being opened so that the outer sleeve is rotated relative to the inner cylinder of the damper. Thus, the roller pin is disengaged from the notch of the outer sleeve to release the flap door from the locked condition, and, if the hand pressing the flap door is pulled away from it, the flap door automatically turns downward by its own dead weight, although the inner cylinder of the damper is rotated in the sense opposite to that in which it is rotated when the flap door is being opened to dampen the torque of the flap door so that the latter softly rotates until it reaches the vertical closed position.

A device according to the second aspect of the present invention differs from the above described device according to the first aspect of the invention in that, while the roller pin is held at the opposite ends thereof in respective curved slots so that it gyrates along the slots with a given radius of gyration in the above description, a pair of links are pivotably fitted to respective lateral plates at a lower end portion thereof so that the links may rotate around the portions and a roller pin is supported at the opposite ends by said links at an upper portion thereof. Thus, the roller pin can gyrate with a given radius of gyration so that it operates exactly as its counterpart of the above described device.

Now, the invention will be described in greater detail by referring to the accompanying drawings that illustrate preferred embodiment of the present invention.

DETAILED DESCRIPTION OF THE EMBODIMENT

Figure 1:
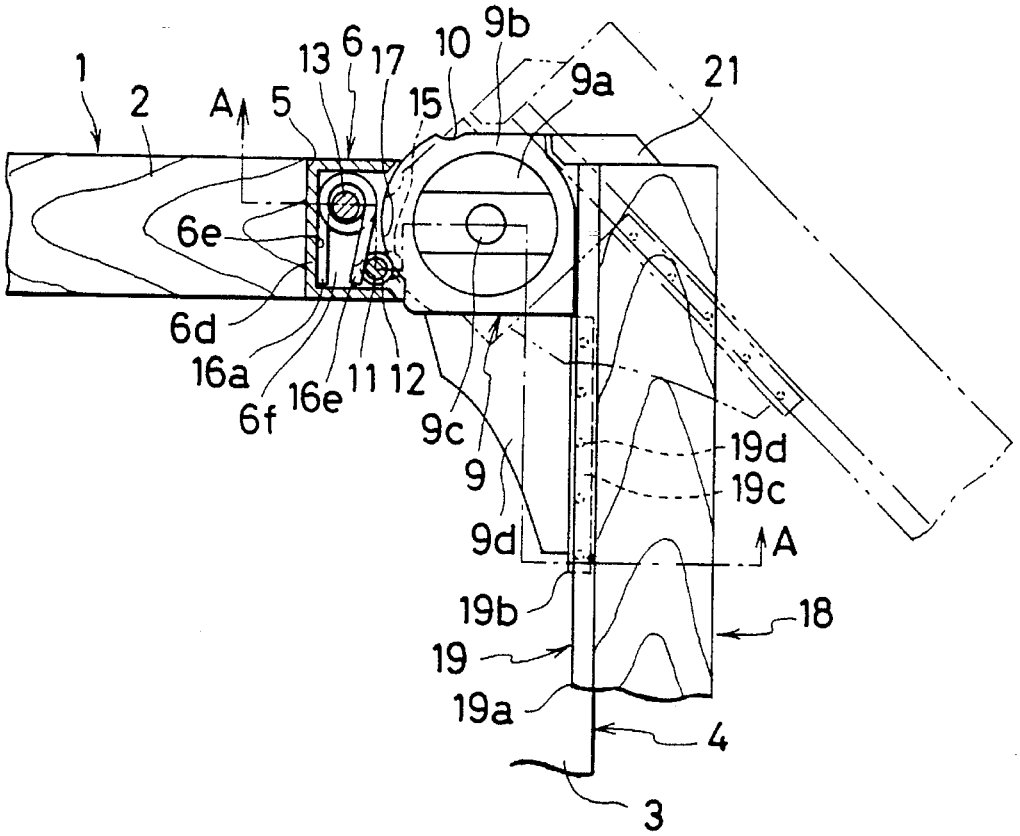
FIG. 1 is a partially cut out sectional side view of a first embodiment of the device for holding a flap door to a horizontal position according to the invention, showing the flap door still in a vertical closed position.
Figure 2:
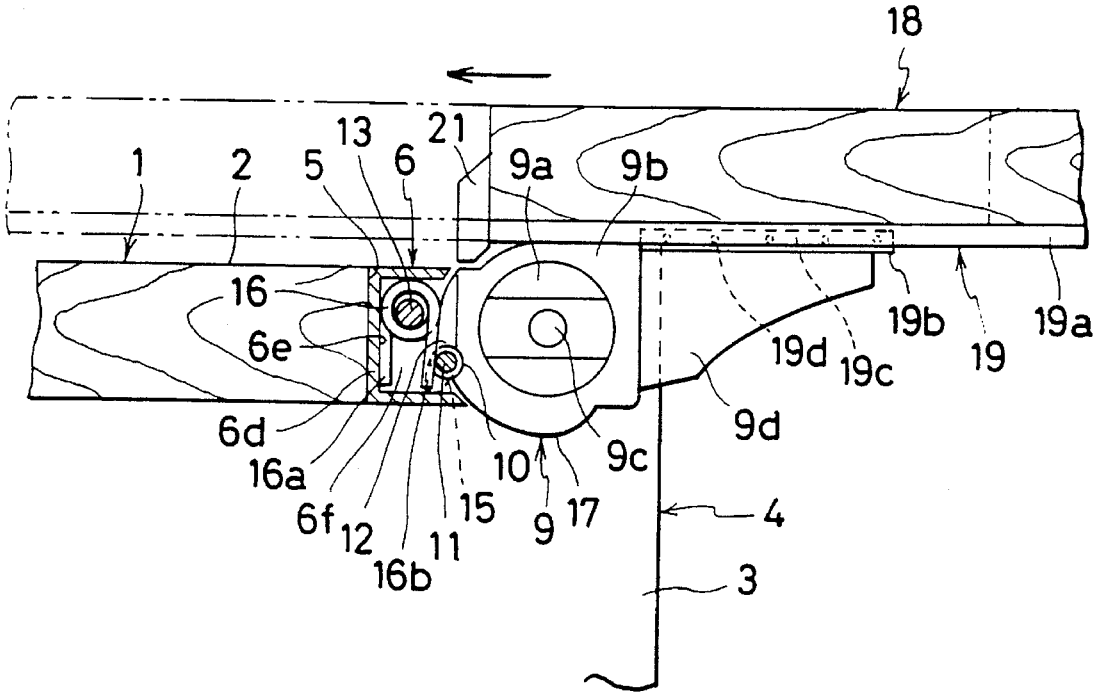
FIG. 2 is a view similar to FIG. 1 but showing the flap door in a horizontal open position.

Referring first to FIG. 1 showing a partially cut out sectional side view of a first embodiment of the device for holding a flap door to a horizontal position, the flap door being still in a vertical closed position, and FIG. 2 showing the flap door in a horizontal open position, a hollow body i such as a cabinet is typically box-shaped and comprises a top wall 2, a bottom plate (not shown) and a pair of lateral plates 3 and a back plate (not shown) and has an open front side 4.

Figure 3:
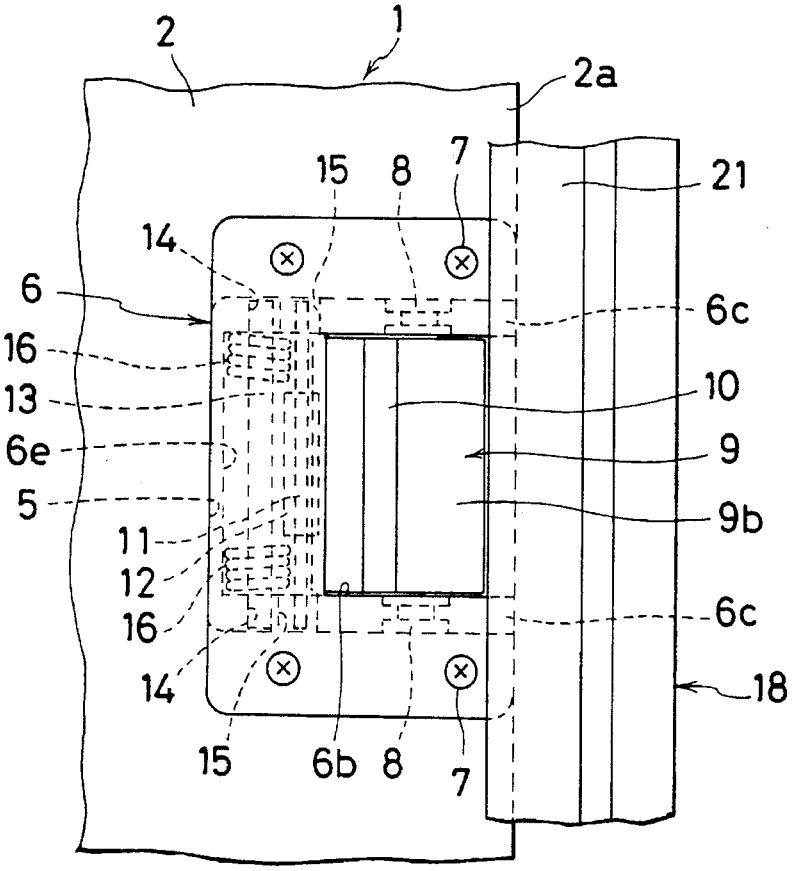
FIG. 3 is a plan view of the embodiment of FIG. 1, showing the flap door in a vertical closed position.
Figure 4:
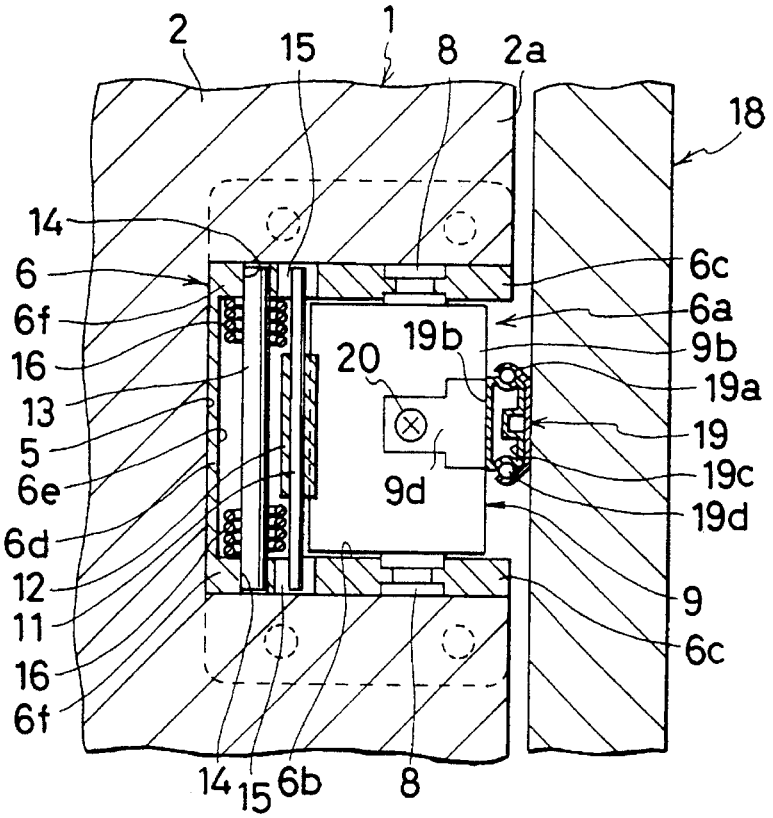
FIG. 4 is a sectional plan view of the embodiment of FIG. 1, taken along A—A" in FIG. 1.

As seen in FIG. 3, which is a plan view of the embodiment of FIG. 1, showing the flap door in a vertical closed position, and FIG. 4 which is a sectional plan view of the embodiment of FIG. 1, taken along A—A" in FIG. 1, the top plate 2 of the hollow body 1 has a pair of cut-out sections 5 near the lateral ends of the front edge 2*a* thereof and a bracket 6 having an opening at the front side and a substantially U-shaped plan view is received in and rigidly secured to each of the cut-out sections 5 by means of screws 7, . . .

The bracket 6 comprises a recess 6*b* cut along a side thereof and a pair of lateral plates 6*c*, 6*c* provided with respective bearing sections 8, 8 for securely receiving respective shafts 9*c*, 9*c* of a damper 9. The damper 9 also comprises an inner cylinder 9*a*, an outer sleeve 9*b* and a unit main body 9*d* and said rotary shafts 9*c*, 9*c* extend outwardly from the opposite ends of the inner cylinder 9*a* of the damper 9 such that said outer sleeve 9*b* is freely rotatable relative to the inner cylinder which is rigidly held by the bracket 6.

The outer sleeve 9*b* is rigidly secured to the unit main body 9*d* and has a notch 10 axially extending along the outer peripheral surface thereof for engagedly receiving a roller pin 11 when a flap door fitted to the hollow body is held to an open position, which will be described in detail hereinafter.

The bracket 6 also comprises a bottom plate 6*d*, a pair of lateral plates 6*c*, 6*c* and the bottom plate 6*d* is provided with a groove 6*e* having an opening connected to the recess 6*b* and extending along the axis of the damper 9. The groove 6*e* is defined at the opposite ends by a pair of lateral walls 6*f*, 6*f*, which are provided with respective bearing holes 14, 14 for receiving the opposite ends of a spindle 13 that will be described in detail hereinafter. On the other hand, the lateral plates 6*c*, 6*c* are provided with respective curved slots 15, 15 for receiving the roller pin 11, said slots being located at the groove 6*e* and in front of the respective bearing holes 14, 14 and extending obliquely from an upper front portion down to a lower rear portion of the respective lateral plates 6*c*, 6*c*.

Figure 5:
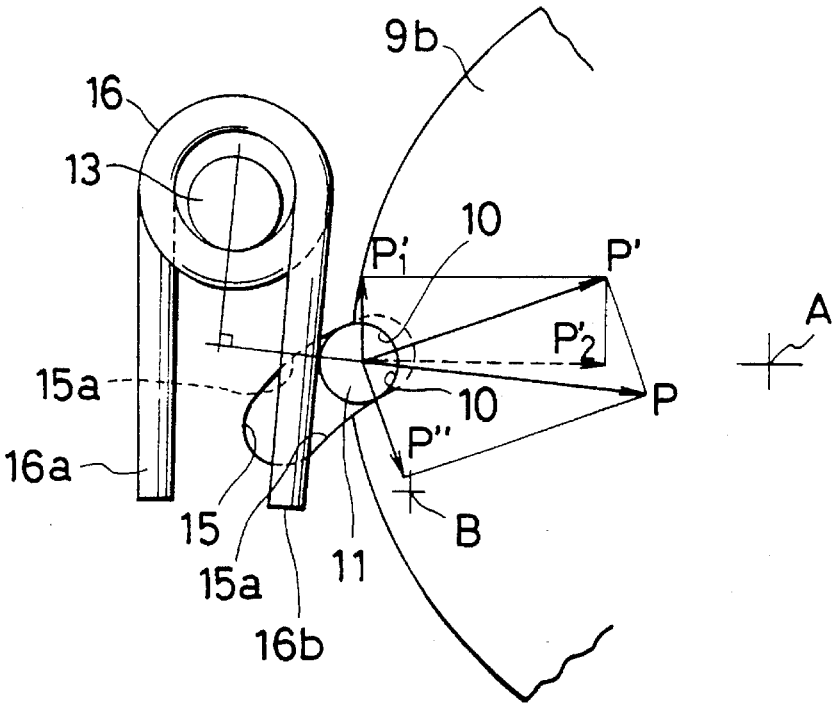
FIG. 5 is a schematic illustration showing the principle of the operation of the device when the flap door is in a locked horizontal open position.
Figure 6:
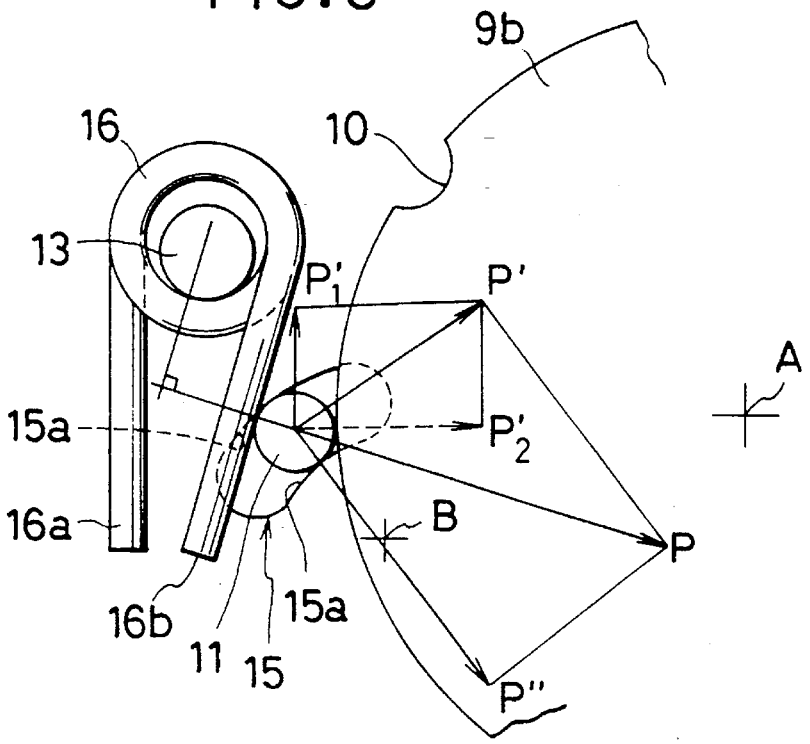
FIG. 6 is an illustration similar to FIG. 5 but showing the principle of the operation of the device when the flap door is released from a locked condition.

As seen in FIGS. 1 and 2 and also in FIGS. 5 and 6, showing the principle of the operation of the device when the flap door is in a locked horizontal open position and when the the flap door is released from a locked condition, respectively, each of the curved slots 15, 15 extending obliquely from an upper front portion down to a lower rear portion of the lateral plate 6*c* as it is drawn with a given radius of curvature around a center of curvature B.

Thus, as the roller pin 11 is arranged in the opening of the groove 6*e* and received by the curved slots 15, 15 at the opposite ends thereof, it can slidably move along the curved slots.

On the other hand, the spindle 13 is received in the bearing holes 14, 14 at the opposite ends thereof, said bearing holes 14, 14 being arranged at the lateral walls 6*f*, 6*f* of the groove 6*e*, and carries a pair of springs 16, 16, typically coil springs, near the opposite ends of its outer periphery such that the coil springs 16, 16 are also arranged in the groove 6*e*. Each of the coil springs 16, 16 has an end 16*a* held on the bottom of the groove 6*e* and the other end 16*b* hooked on and held by the roller pin 11 in such a way that the roller pin 11 is constantly urged forward by the coil springs 16, 16 and pressed against the outer peripheral surface of the outer sleeve 9*b* of the damper 9. While the roller pin 11 of the embodiment is provided at the middle portion thereof with a locking roller pin section 12 as shown in the related drawings, it is to be noted that it does not constitute an essential part of the present invention.

The oblong notch 10 of the outer sleeve 9*b* and the locking roller pin section 12 on the bracket 6 are positionally so arranged that they are out on engagement when the flap door is in the vertical closed position, whereas they come into a mutual engagement when the flap door is held to the horizontal open position. It may be clear that the roller pin 11 is releasably engaged with the notch 10, if a locking roller pin section 12 is not in use.

If the outer sleeve 9*b* of the damper 9 is additionally provided with a curved slope 17 on the outer peripheral surface such that the roller pin 11 or the locking roller pin section 12 come into engagement therewith when the flap door is in the vertical closed position as seen in FIGS. 1, 3 and 4, the flap door is urged to move to the closed position by the locking roller pin section 12 by way of the curved catching slope 17 once the door is turned toward the closed position. With this arrangement, the flap door is locked whenever it is closed.

The damper 9 is of a known type that comprises a high molecular viscous fluid and a spring and is designed to make use of the viscous shearing drag of the viscous fluid and the resilient force of the spring such that it produces braking power when the outer sleeve 9*b* is rotated relative to the inner cylinder 9*a* to open the flap door whereas its spring assists the rotary motion of the outer sleeve 9*b* when the flap door is opened.

The flap door denoted by reference numeral 18 in FIGS. 1 through 4 has appropriate dimensions to completely cover the opening 4 of the hollow body 1 and provided on its inner surface with a pair of slide rail assemblies near the lateral ends thereof at locations corresponding to the respective dampers 9, 9. More specifically, each of the slide rail assemblies has an outer rail 19*a*, which is longitudinally arranged along and rigidly fitted to the inner surface of the flap door 18.

As best seen in FIG. 4, the slide rail assembly 19 comprises an outer rail 19*a* and an inner rail 19*b* with a plurality of balls 19*d*, and a pair of lateral ball retainers 19*c*, 19*d* arranged therebetween in such a way that the inner rail 19*b* is engaged with the outer rail 19*a* and longitudinally slidable relative to the outer rail 19*a*. As shown in FIGS. 1 and 2, the outer rail 19*a* has an length substantially equal to the height of the flap door 18 while the inner rail 19*b* is substantially shorter than the outer rail 19*a* to allow the flap door 18 to have a large sliding stroke.

Then, the inner rail 19*b* of the slide rail assembly is rigidly secured to the unit main body 9*d* which is rigidly connected to the outer sleeve 9*b* of the damper 9 by means of screws 20, as shown in FIG. 4. Thus, when the flap door 18 is in the vertical closed position as indicated by solid lines in FIG. 1, it can freely turn upward relative to the opening 4 of the hollow body 1 around the rotary shafts 9*c*, 9*c* to open the hollow body.

A holder/guide plate 21 is projecting rectangularly from the rear side of the outer rail 19*a* of the slide rail assembly. When the flap door 18 is in the vertical closed position as shown in FIG. 1, it is engaged with the damper 9 to prevent mutual disengagement of the inner rail 19*b* and the outer rail 19*a* so that the flap door 18 would not fall down in any event. When, on the other hand, the flap door 18 is in the horizontal open position as shown in FIG. 2, the holder/guide plate 21 is slidingly movable along the upper surface of the top wall 2 of the hollow body 1 to the "put away" position.

When the flap door 18 is fully pulled forward from the "put away" position as shown in FIG. 2, the holder/guide plate 21 abuts and engages with the outer peripheral surface of the outer sleeve 9*b* of time damper 9 to prevent the flap door 18 from moving any further to become totally pulled out of the hollow body 1.

Now, the pressure applied to the outer peripheral surface of the outer sleeve 9*b* in the operation of the embodiment will be described by referring to FIGS. 5 and 6 showing the principle of the operation of the device, the locking roller pin section 12 being omitted and only the roller pin 11 being illustrated in the following description, for the sake of simplicity.

In FIG. 5, the flap door 18 is in the locked horizontal open position and the roller pin 11 is received on the oblong notch 10 arranged on the outer peripheral surface of the outer sleeve 9*b*, whereas in FIG. 6 the flap door 18 is released from a locked condition and the roller pin 11 is pressed against the outer peripheral surface of the outer sleeve 9*b* by the resilient force of the spring.

When the flap door 18 is locked in the horizontal open position as shown in FIG. 5, the moment stored in each of the springs 16, 16 takes the form of spring force represented by vector P, which is directed to the center of the roller pin 11.

Said vector P can be divided into component vector P' and P", passing through or directed to the center of the curvature B of the curved walls 15*a*, 15*a* of the curved slot 15 of each of the lateral plates and hence representing the pressure of the spring force, the vector P' being perpendicular to the vector P".

On the other hand, the vector P' can by turn be divided into component vectors $P_1'$ and $P_2'$, the vector $P_2'$ passing through or being directed to the axis A of the outer sleeve of the damper 9, the vector $P_1'$ being perpendicular to the vector $P_2'$ to prove that, after all, the net pressure applied to the outer surface of the outer sleeve and directed to the axis A of the outer sleeve is $P_2'$.

Referring now to FIG. 6 of the accompanying drawings also schematically illustrating the principle of the operation of the device, each of the springs 16, 16 is more deformed when the flap door is being opened than when the latter is in the above described locked open position, the moment stored in the spring also taking the form of spring force represented by vector P in FIG. 6, which passes through the center of the roller pin.

Again, the vector P can be divided into component vectors P' and P", the vector P" passing through or being directed to the center of curvature B of the curved walls 15*a*, 15*a* of the curved slot 15 of the each of the lateral plates and hence representing the pressure of the spring force, the vector P' being perpendicular to the vector P".

Again, the vector P' can be divided into component vectors $P_1'$ and $P_2'$, the vector $P_2'$ passing through or being directed to the axis A of the outer sleeve of the damper 9, the vector $P_1'$ being perpendicular to the vector $P_2'$ to prove that, after all, the net pressure applied to the outer peripheral surface of the outer sleeve and directed to the axis A of the outer sleeve is $P_2'$.

In view of the above description and if it is assumed that the ratio of spring forces when the spring is less deformed as shown in FIG. 1 and when it is more deformed as shown in FIG. 2 is 3:4, the ratio of the pressures $P_2'$ applied by the roller pin 11 to the oblong notch 10 and the outer peripheral surface of the outer sleeve 9*b* is 2.5:2 to prove that the pressure applied to the outer peripheral surface of the outer sleeve 9*b* does not increase as greatly as the spring force P when the spring is more deformed.

While the roller pin 11 slides along the curved slots 15, 15 in the above embodiment, the curved slots 15, 15 may be replaced with a pair of links to achieve the same effect.

Figure 7:
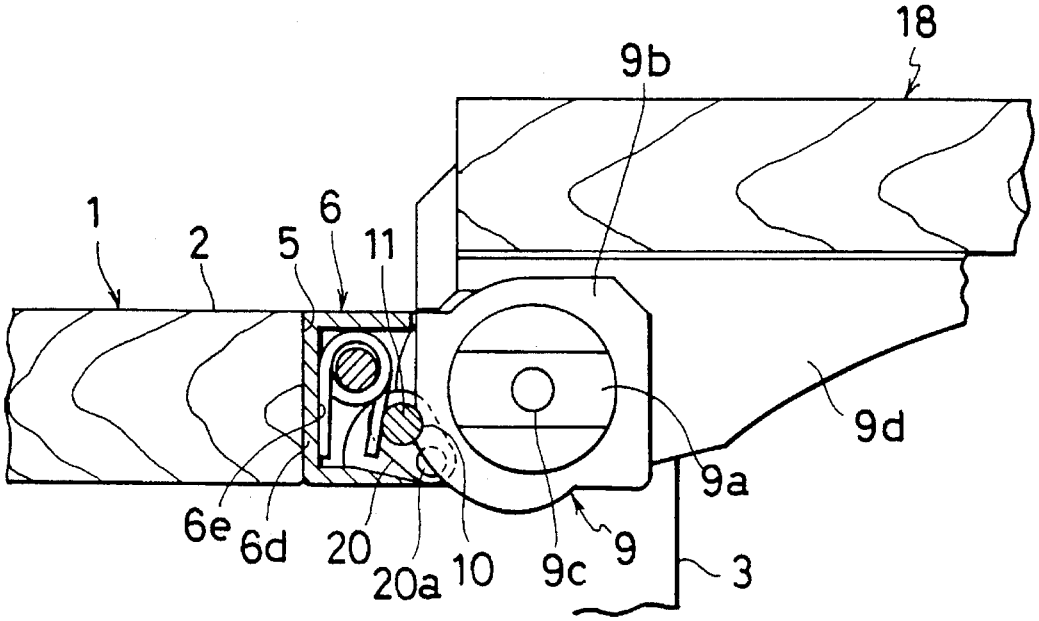
FIG. 7 is a partially cut out sectional side view of a second embodiment of device for holding a flap door to a horizontal position according to the invention, showing the flap door in a vertical closed position.
Figure 8:
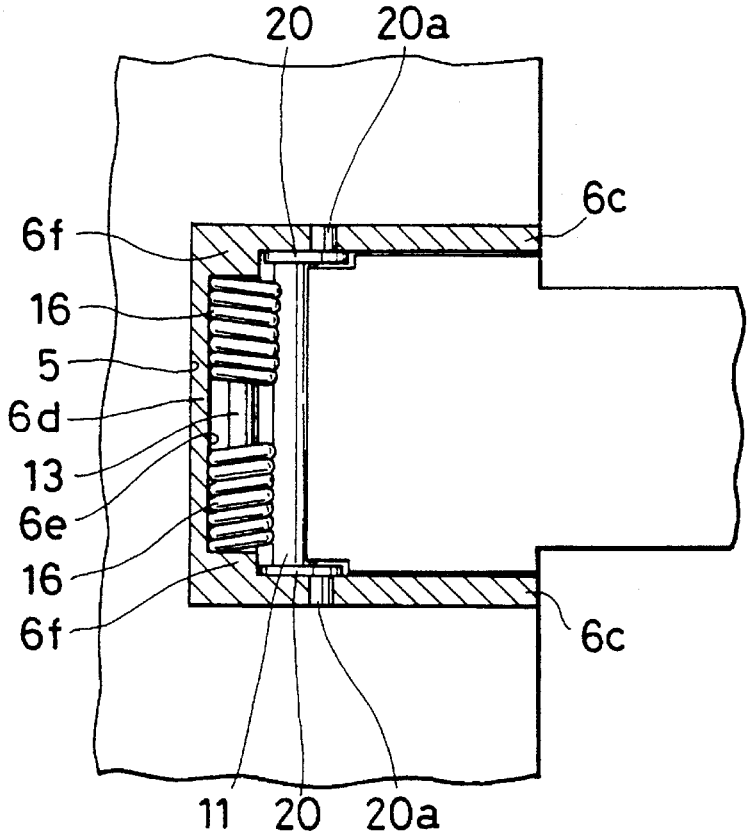
FIG. 8 is a view similar to FIG. 7 but showing the flap door in a horizontal open position.
Figure 9:
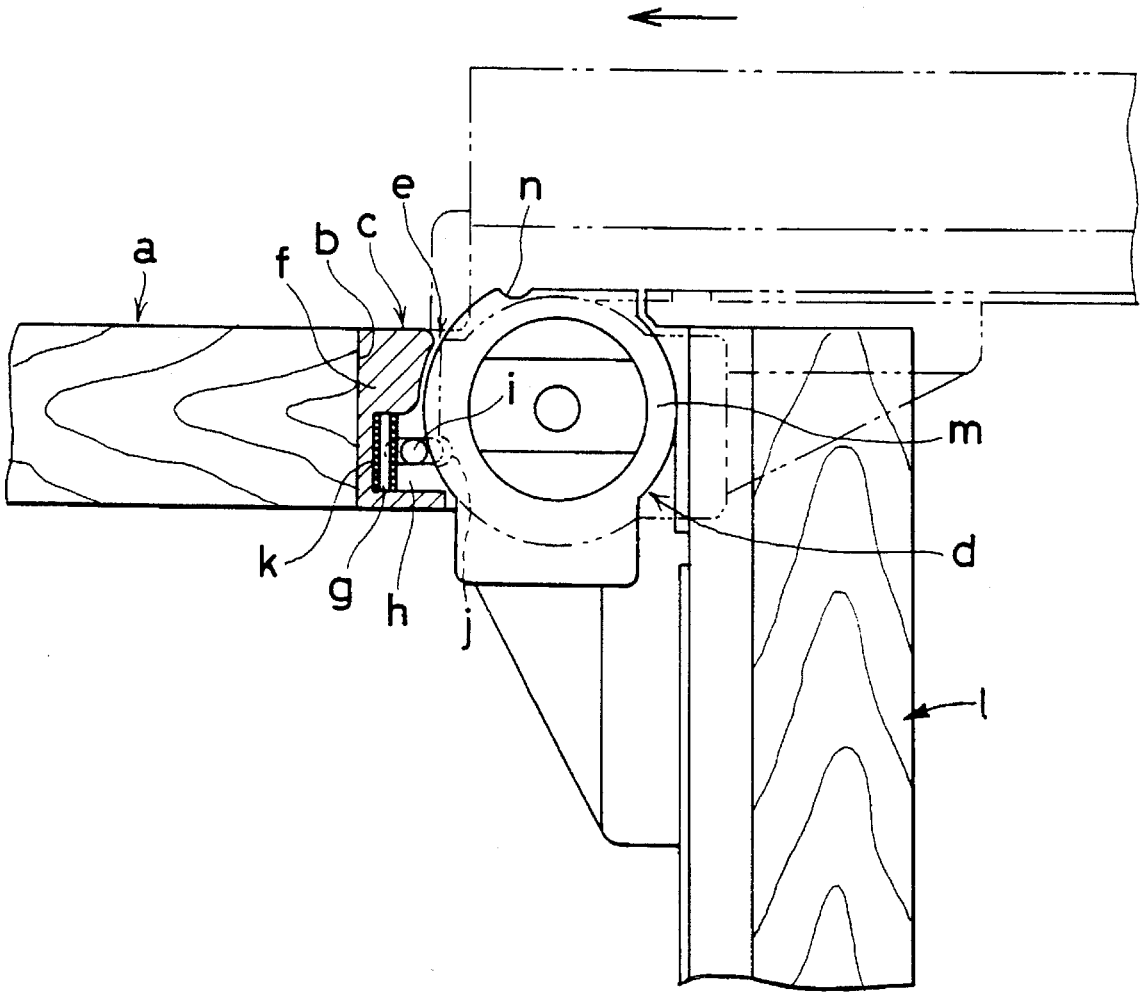
FIG. 9 PRIOR ART
FIG. 9 is a partially cut out sectional side view of a conventional device for holding a flap door to a horizontal position, showing the flap door in a vertical closed position.

Referring to FIGS. 7 and 8 illustrating the second embodiment of the present invention that utilizes links, unlike the roller pin 11 of the first embodiment that is guided by a pair of curved slots 15, 15 to gyrate, the roller pin 11 of this second embodiment is pivotably supported by and bridge upper portion of a pair of links 20, 20 which are by turn also pivotably supported by the respective side plates 6*c*, 6*c* at the lower end portions 20*a*, 20*a* thereof.

Thus, the roller pin 11 can gyrate around the pins 20*a*, 20*a* of the links 20, 20 both clockwise and counterclockwise with a radius of gyration equal to the distance between the roller pin 11 and the pin 20*a* of each of the links 20, 20, and is urged upward by the springs 16, 16 and pressed against the outer peripheral surface of the outer sleeve 9*b* of the damper 9 as in the case of the first embodiment.

Therefore, because of the provision of a pair of links 20, 20, the roller pin 11 of this embodiment gyrates exactly the same way as its counterpart of the first embodiment which is guided by a pair of curved slots for gyration to achieve the same effect for the device.

As described in detail above, a device according to the first aspect of the invention operates to reduce the braking force of the damper when the flap door is being opened whereas it causes the damper to exert its braking force when the flap door is being closed so that the latter may be slowly and softly closed. The device basically operates to hold the flap links to achieve the same effect.

Referring to FIGS. 7 and 8 illustrating the second embodiment of the present invention that utilizes links, unlike the roller pin 11 of the first embodiment that is guided by a pair of curved slots 15, 15 to gyrate, the roller pin 11 of this second embodiment is pivotably supported by and bridge upper portion of a pair of links 20, 20 which are by turn also pivotably supported by the respective side plates 6*c*, 6*c* at the lower end portions 20*a*, 20*a* thereof.

Thus, the roller pin 11 can gyrate around the pins 20*a*, 20*a* of the links 20, 20 both clockwise and counterclockwise with a radius of gyration equal to the distance between the roller pin 11 and the pin 20*a* of each of the links 20, 20, and is urged upward by the springs 16, 16 and pressed against the outer peripheral surface of the outer sleeve 9*b* of the damper 9 as in the case of the first embodiment.

Therefore, because of the provision of a pair of links 20, 20, the roller pin 11 of this embodiment gyrates exactly the same way as its counterpart of the first embodiment which is guided by a pair of curved slots for gyration to achieve the same effect for the device.

As described in detail above, a device according to the first aspect of the invention operates to reduce the braking force of the damper when the flap door is being opened whereas it causes the damper to exert its braking force when the flap door is being closed so that the latter may be slowly and softly closed. The device basically operates to hold the flap door 18 to a horizontal open position under a locked condition so that there is no need of providing any additional means for supporting the dead weight of the flap door once the flap door is held to the horizontal open position. When, on the other hand, the flap door is pulled forward from its "put away" position, the flap door does not unintentionally turn nor fling downward, because it is held to the horizontal open position. This effect of holding the flap door horizontally is achieved by providing an oblong notch arranged on the outer peripheral surface of the outer sleeve of the damper, a roller pin disposed in the bracket and urged forward by the resilient force of one or more than one springs to engage with the oblong notch and a pair of curved slots cut through the lateral plates of the bracket to guide the roller pin, said curved slots extending obliquely from an upper front portion down to lower rear portion of the lateral plates with a given radius of curvature. With this arrangement, the pressure applied by the roller pin against the outer peripheral surface of the outer sleeve of the damper does not remarkably increase even when the springs are greatly deformed to strongly urge the roller pin forward and the roller pin rotates along the outer peripheral sur face of the outer sleeve of the damper so as not to produce large friction therebetween. Thus, the flap door is relieved of any undesired heavy load when it is in an unlocked condition so that it may be turned lightly and softly whenever it is opened. Consequently, all the related components are made relatively free from tear and wear and hence have a prolonged service life.

A device according to the second aspect of the invention operates substantially the same as the above described device, because its roller pin is also made to gyrate with a given radius of gyration by means of a pair of links in place of a pair of curved slots of the above described device.

What is claimed is:

1. A device for holding a flap door to a horizontal position, said flap door comprising a damper fitted to a bracket arranged in a cut-out section of an edge of a top wall of a hollow body such as a cabinet, said damper including an inner cylinder rigidly secured to said hollow body, an outer sleeve connected to said door and rotatably mounted on said inner cylinder and a slide rail assembly having a longer rail and a shorter rail mutually slidably combined with a ball retainer arranged therebetween, said longer rail being securely fitted to an inner surface of the flap door, said shorter rail being rigidly fitted to said outer sleeve of the damper so as to allow the flap door to move between a fully open position overlying an upper surface of the top wall of the hollow body and a closed position perpendicular to the top wall by a combination of swinging and sliding movements, characterized in that said bracket comprises a bottom plate and a pair of lateral plates, said bottom plate having a recess and a groove having an opening connected to the recess, said lateral plates having respective curved slots extending obliquely from an upper portion adjacent the edge of the top wall down to a lower portion of the lateral plates remote from the edge of the top wall, said slots having a given radius of curvature, a roller pin extending between the lateral plates and received in the slots at the opposite ends thereof, and a spring disposed in said groove to urge the roller pin toward the edge of the top wall, the outer sleeve of the damper having a notch arranged on the outer periphery thereof for releasably engaging said roller pin when the door is at an open horizontal position to hold the door in the open horizontal position.

2. A device for holding a flap door to a horizontal position, said flap door comprising a damper fitted to a bracket arranged in a cut-out section of an edge of a top wall of a hollow body such as a cabinet, said damper including an inner cylinder rigidly secured to said hollow body, an outer sleeve connected to said door and rotatably mounted on said inner cylinder and a slide rail assembly having a longer rail and a shorter rail mutually slidably combined with a ball retainer arranged therebetween, said longer rail being securely fitted to an inner surface of the flap door, said shorter rail being rigidly fitted to said outer sleeve of the damper so as to allow the flap door to move between a fully open position overlying an upper surface of the top wall of the hollow body and a closed position perpendicular to the top wall by a combination of swinging and sliding movements, characterized in that said bracket comprises a bottom plate and a pair of lateral plates, said bottom plate having a recess and a groove having an opening connected to the recess, said lateral plates having respective links pivotally fitted thereto at a lower end portion of the links, a roller pin supported by said links and extending between the lateral plates at the opposite ends of the links, said roller pin being rotatable with a given radius of gyration, and a spring disposed in said groove to urge the roller pin toward the outer sleeve, said outer sleeve of the damper having a notch arranged on the outer periphery thereof for releasably engaging said roller pin when the door is at an open horizontal position to hold the door in the open horizontal position.

3. A damper for holding a pivotally mounted door at the edge of a wall in which the door is pivoted from an open horizontal position to a closed vertical position extending downwardly from said wall, said damper holding the door in open horizontal position against the force of gravity pivoting the door downwardly to closed vertical position, said damper comprising an outer sleeve mounted on said door and an inner cylinder mounted on said wall, a bracket attached to said wall supporting said damper for pivotal movement of the outer sleeve about a generally horizontal axis to enable pivotal movement of the door between open and closed positions, said sleeve including a horizontally disposed notch, a latch member mounted on the bracket and spring biased towards said sleeve for entry into the notch on the outer sleeve when the door is in a horizontal position thereby retaining the door in horizontal position until the spring biased latch is moved out of the notch by downward pressure being exerted on the door in spaced relation to the pivotal connection between the bracket and outer sleeve.

4. The damper as defined in claim 3 wherein said latch member is in the form of a roller pin, said roller pin being supported by arcuate slots in end walls of said bracket, a spring member mounted on the bracket engaged with the roller pin to bias the roller pin toward the outer sleeve for biasing the pin into engagement with the notch and retaining it in engagement with the notch thereby releasably retaining the door in horizontal position.

5. The damper as defined in claim 3 wherein said latch member is in the form of a roller pin having offset links at each end pivotally supported from said bracket, a spring mounted on the bracket engaged with the roller pin to pivot the roller pin about ends of said links to move it into engagement with the notch when the door is moved to horizontal position thereby releasably retaining the door in horizontal position.

* * * * *